US009774148B1

(12) United States Patent
I

(10) Patent No.: US 9,774,148 B1
(45) Date of Patent: Sep. 26, 2017

(54) SOCKET WHICH IS TURNED OFF AT A LIMITING TEMPERATURE

(71) Applicant: Green Idea Tech Inc., Mahe (SC)

(72) Inventor: Hsiang-Yun I, Tainan (TW)

(73) Assignee: Green Idea Tech Inc., Mahe (SC)

( * ) Notice: Subject to any disclaimer, the term of this patent is extended or adjusted under 35 U.S.C. 154(b) by 0 days.

(21) Appl. No.: 15/471,687

(22) Filed: Mar. 28, 2017

(51) Int. Cl.

| | |
|---|---|
| ***H01R 13/68*** | (2011.01) |
| ***H01R 13/11*** | (2006.01) |
| ***H01R 25/00*** | (2006.01) |
| *H01R 103/00* | (2006.01) |

(52) U.S. Cl.
CPC ..... *H01R 13/68* (2013.01); *H01R 13/11* (2013.01); *H01R 25/003* (2013.01); *H01R 2103/00* (2013.01)

(58) Field of Classification Search
CPC ..... H01R 13/68; H01R 13/11; H01R 25/003; H01R 2103/00
USPC ..... 439/301, 507, 620.3
See application file for complete search history.

(56) References Cited

U.S. PATENT DOCUMENTS

| | | | | |
|---|---|---|---|---|
| 9,257,798 | B2 | 2/2016 | Wang | |
| 9,325,122 | B1 * | 4/2016 | Goyal | H01H 85/20 |
| 9,478,876 | B1 * | 10/2016 | Wang | H01R 13/113 |
| 9,627,821 | B1 * | 4/2017 | I | H01R 13/68 |

FOREIGN PATENT DOCUMENTS

| | | |
|---|---|---|
| TW | M509999 U | 10/2015 |

* cited by examiner

*Primary Examiner* — Khiem Nguyen
(74) *Attorney, Agent, or Firm* — Muncy, Geissler, Olds & Lowe, P.C.

(57) ABSTRACT

A socket turned off at a limiting temperature includes a live wire conductive plate, live wire terminals, a neutral wire conductive plate, neutral wire terminals, a seat, protective structures, and a support element. The seat installs the live wire conductive plate, the live wire terminals, the neutral wire conductive plate and the neutral wire terminals. A predetermined gap is between a live wire conductive spring plate and a live wire contact portion as well as between a neutral wire spring plate and a neutral wire contact portion. The protective structure provides a force of constraint, allowing the live wire spring plate to contact with the live wire contact portion as well as the neutral wire spring plate to contact with the neutral wire contact portion. The support element provides a supporting force corresponding to the force of constraint.

9 Claims, 10 Drawing Sheets

SOCKET WHICH IS TURNED OFF AT A LIMITING TEMPERATURE

BACKGROUND OF THE INVENTION a) Field of the Invention

The present invention relates to a socket which is turned off at a limiting temperature, and more particularly to a socket which is turned off if the working temperature is too high.

b) Description of the Prior Art

To prevent a circuit from issues of current overload, short circuit and overheating, a fuse or an overload protector is usually provided at the circuit. When the temperature of the circuit gets too high or the current gets too large, the fuse affected by the high temperature becomes blown or a bi-metal shrapnel of the overload protector becomes disengaged, so as to cause the circuit become open circuit and turned off to ensure electricity safety.

The Taiwan Utility Model Patent M509999, "Overheating Destructive Insulative Fixing Plate as well as a Plug and a Socket Using that Insulative Fixing Plate," has disclosed an overheating destructive insulative fixing plate, which includes a connecting element and two limiting elements combined at two ends of the connecting element to form an H-shaped structure. The connecting element is put into the grooves formed on the conductive elements, enabling the two limiting elements to be abutted at an exterior side of the conductive element respectively and limiting the two conductive elements from contacting with each other. The connecting element is destructed when overheating, forming an open circuit between the two conductive elements.

However, each live wire spring plate and each live wire conductive plate will use an overheating destructive fixing plate, and each neutral wire spring plate and each neutral wire conductive plate will use another overheating destructive fixing plate, as shown in FIG. 21 of the abovementioned patent M509999. When a load (electric appliance) is connected between the live wire conductive plate and the neutral wire conductive plate, the electric current will flow through the live wire spring plate, the live wire conductive plate, the load (electric appliance), the neutral wire conductive plate and the neutral wire spring plate orderly to form an open path. If the location of overheating is between the neutral wire spring plate and the neutral wire conductive plate, then the fixing plate between the neutral wire spring plate and the neutral wire conductive plate will be destructed due to overheating. At this time, the fixing plate between the live wire spring plate and the live wire conductive plate may not be destructed. Therefore, the high electric current can still enter into the load prior to forming an open circuit; whereas, if electricity leaks out of the load and an operator touches the load under grounding, then the operator may get an electric shock.

Furthermore, in the embodiment shown in FIG. 1, FIG. 2 and FIG. 3 of the U.S. Pat. No. 9,257,798, a limiting element is used independently between the live wire conductive plate and the live wire contact portion, and another limiting element is also used independently between the neutral wire conductive plate and the neutral wire contact portion. Accordingly, that U.S. Pat. No. 9,257,798 is also provided with the same issue as the abovementioned Taiwan Utility Model Patent M509999. In other words, under overheating, in the structure disclosed in the U.S. Pat. No. 9,257,798, it is possible that only the limiting element between the neutral wire conductive plate and the neutral wire contact portion is destructed, but the limiting element between the live wire conductive plate and the live wire contact portion remains intact.

SUMMARY OF THE INVENTION

Accordingly, to assure that the live wire spring plate and the live wire conductive plate located before the load can be tripped off actually when the electric circuit is overheated, the present invention discloses a socket which is turned off at a limiting temperature. The socket includes a live wire conductive plate which is provided at least with a live wire spring plate; at least a live wire terminal which is provided with a live wire contact portion; a neutral wire conductive plate which is provided at least with a neutral wire spring plate; at least a neutral wire terminal which is provided with a neutral wire contact portion; a seat which is provided with a live wire installation portion and a neutral wire installation portion, with that the live wire installation portion is used to install the live wire conductive plate and the live wire terminals, the neutral wire installation portion is used to the install the neutral wire conductive plate and the neutral wire terminals, and a predetermined gap is disposed between the live wire spring plates and the live wire contact portion as well as between the neutral wire spring plates and the neutral wire contact portion; at least a protective structure which is provided with a first limiting element, a second limiting element and a connecting element, with that the connecting element is connected with the first limiting element and the second limiting element, the first limiting element and the second limiting element are abutted at the live wire spring plate and the neutral wire spring plate respectively to provide a force of constraint to allow the live wire spring plate and the live wire contact portion to contact with each other as well as the neutral wire spring plate and the neutral wire contact portion to contact with each other, and the protective structure is damaged to lose the force of constraint when there is overheating between the live wire spring plate and the live wire contact portion or between the neutral wire spring plate and the neutral wire contact portion; and a support element which is provided at least with a support unit, with that the support unit includes at least a first abutting portion and at least a second abutting portion, the first abutting portion is abutted at the live wire contact portion and the live wire installation portion, and the second abutting portion is abutted at the neutral wire contact portion and the neutral wire installation portion to provide a supporting force corresponding to the force of constraint.

Furthermore, the support unit defines a containing groove and two fringes. The fringes are disposed at two ends of the containing groove and are abutted directly at the live wire contact portion and the neutral wire contact portion respectively to serve as the first abutting portion and the second abutting portion.

Furthermore, the seat includes a middle portion which is disposed between the live wire installation portion and the neutral wire installation portion. A first separation portion is disposed on a side of the live wire installation portion in adjacent to the middle portion, and a second separation portion is disposed on a side of the neutral wire installation portion in adjacent to the middle portion. The first separation portion and the second separation portion are all provided with a connected installation groove, and at least a part of the support unit is disposed in the installation groove.

Furthermore, the support unit is provided with two fastening portions which are latched in the first separation portion and the second separation portion respectively.

Furthermore, the live wire spring plates of the live wire conductive plate, the live wire terminals, the neutral wire terminals, and the neutral wire spring plates of the neutral wire conductive plate are all plural and disposed on the seat in pairs.

Furthermore, the support unit includes a connecting portion to connect with another neighboring support unit.

Furthermore, the seat includes a middle portion, a first separation portion and a second separation portion. The middle portion is disposed between the live wire installation portion and the neutral wire installation portion, the first separation portion is disposed on a side of the live wire installation portion in adjacent to the middle portion, the second separation portion is disposed on a side of the neutral wire installation portion in adjacent to the middle portion, and two sides of the connecting portion are abutted at the first separation portion and the second separation portion respectively to serve as the first abutting portion and the second abutting portion.

Furthermore, the socket includes a ground wire conductive plate which is disposed on the middle portion, and the support unit is provided with a limiting portion which is abutted at the ground wire conductive plate.

Furthermore, the support element is formed integrally.

The following benefits can be resulted from the abovementioned technical features:

1. When the electric circuit is overheated, the live wire spring plates, the live wire contact portion, the neutral wire spring plates and the neutral wire contact portion will be assured to be tripped off, preventing the load (electrical appliance) from receiving the current any more.
2. By providing the support function from the support element, the seat can be prevented from deformation by the force of constraint of the protective structure, and the live wire spring plate can contact with the live wire contact portion as well as the neutral wire spring plate can contact with the neutral wire contact portion more accurately to conduct the electricity.
3. The support element can be positioned by latching the fastening portions into the first separation portion and the second separation portion to prevent from escaping from the expected installation position.
4. The support element is formed integrally to be assembled easily.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

According to the abovementioned technical features, the primary benefits of the socket which is turned off at a limiting temperature can be clearly disclosed in the following embodiment.

Figure 1:
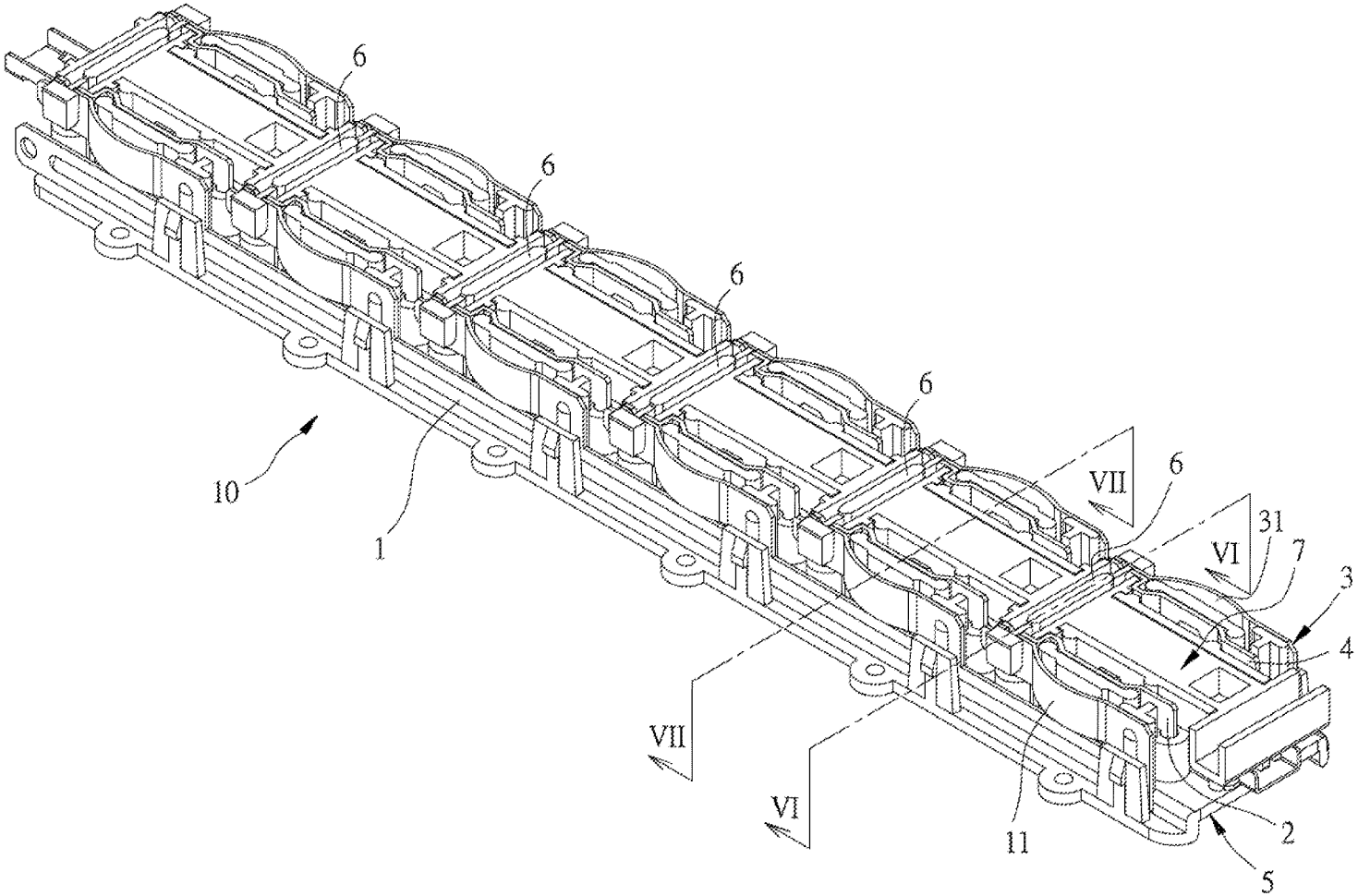
FIG. 1 shows a three-dimensional schematic view of appearance of an embodiment of the present invention.
Figure 2:
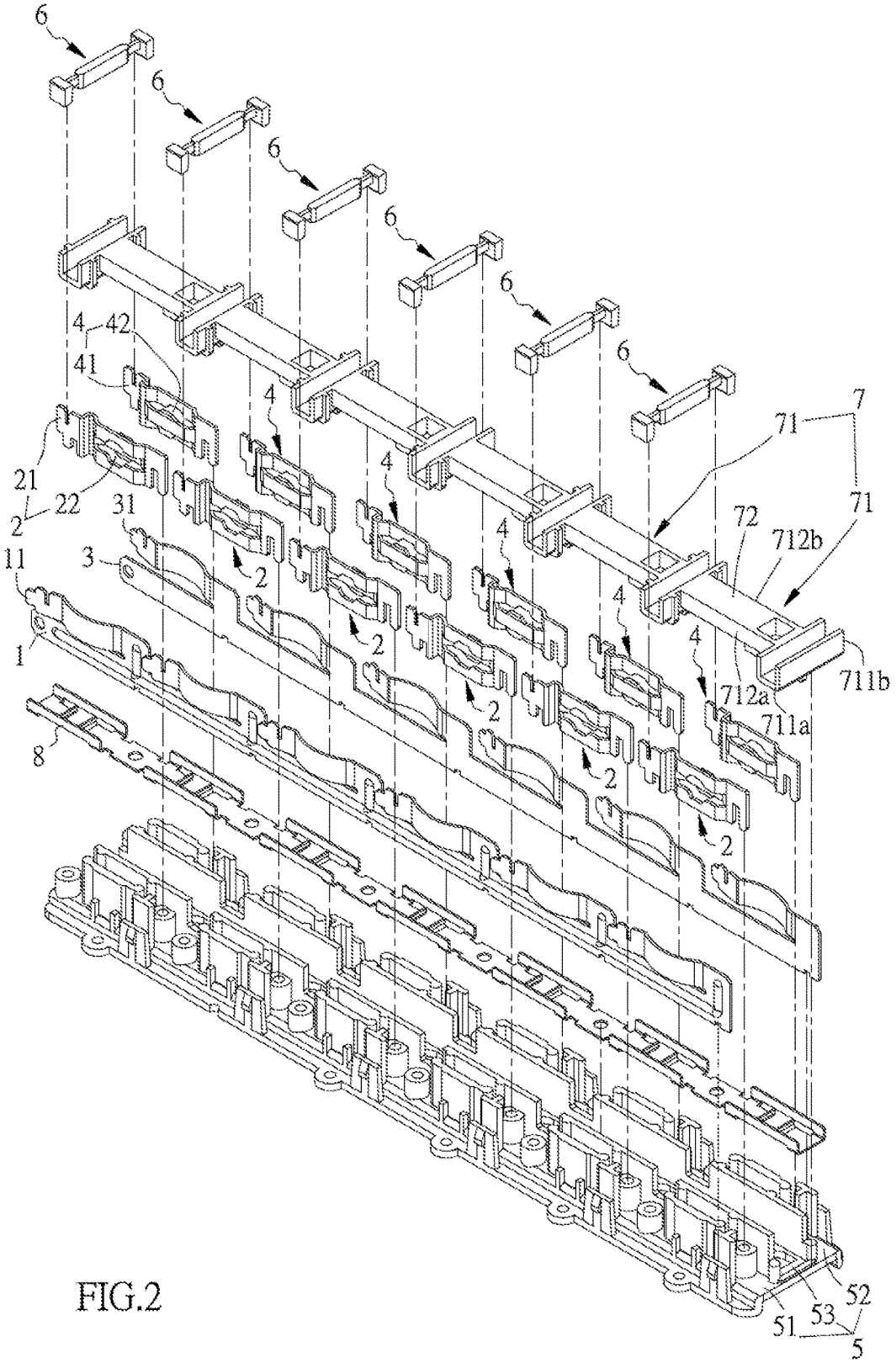
FIG. 2 is a three-dimensional exploded view of the embodiment of the present invention.
Figure 10:
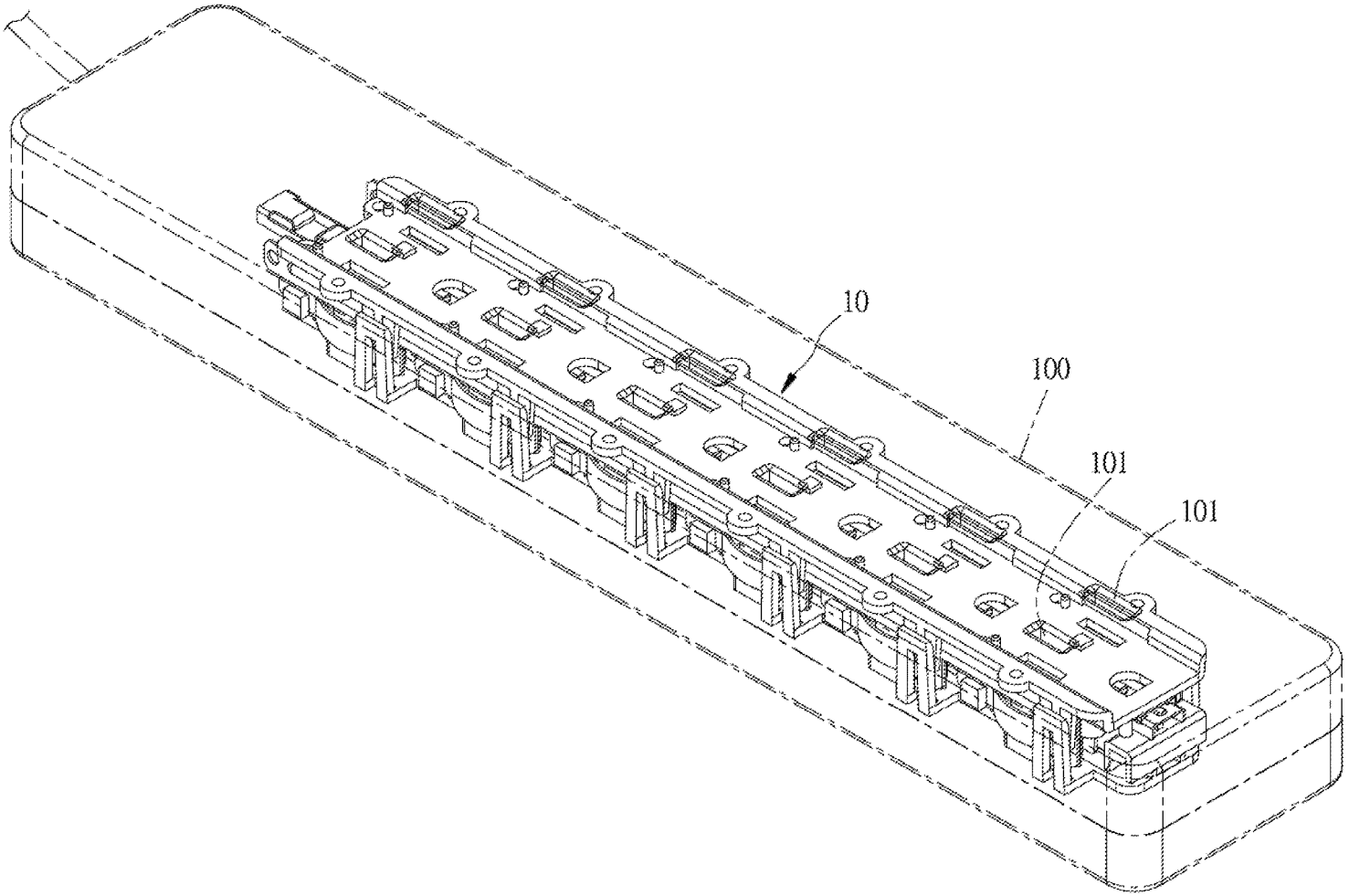
FIG. 10 shows a three-dimensional schematic view of appearance of the embodiment of the present invention, illustrating that a socket body is installed in a socket housing.

Referring to FIG. 1 and FIG. 2, the socket which is turned off at a limiting temperature according to the embodiment of the present invention comprises a live wire conductive plate 1, plural live wire terminals 2, a neutral wire conductive plate 3, plural neutral wire terminals 4, a seat 5, plural protective structures 6 and a support element 7. In addition, the socket can even include a ground wire conductive plate 8. The live wire conductive plate 1 is provided with plural live wire spring plates 11, all the live wire terminals 2 are provided with a live wire contact portion 21 and all define a live wire slot 22, the neutral wire conductive plate 3 is provided with plural neutral wire spring plates 31, all the neutral wire terminals 4 are provided with a neutral wire contact portion 41 and all define a neutral wire slot 42, and the live wire slots 22 and the neutral wire slots 42 are all used for the insertion of pins. The live wire spring plates 11 of the live wire conductive plate 1, the live wire terminals 2, the neutral wire spring plates 31 of the neutral wire conductive plate 3, and the neutral wire terminals 4 are disposed on the seat 5 in pairs to form a socket body 10. As shown in FIG. 10, the socket body 10 can be installed in a socket housing 100, and insertion holes 101 of the socket body 10 correspond with the insertion holes 101 of the socket housing 100.

Figure 3:
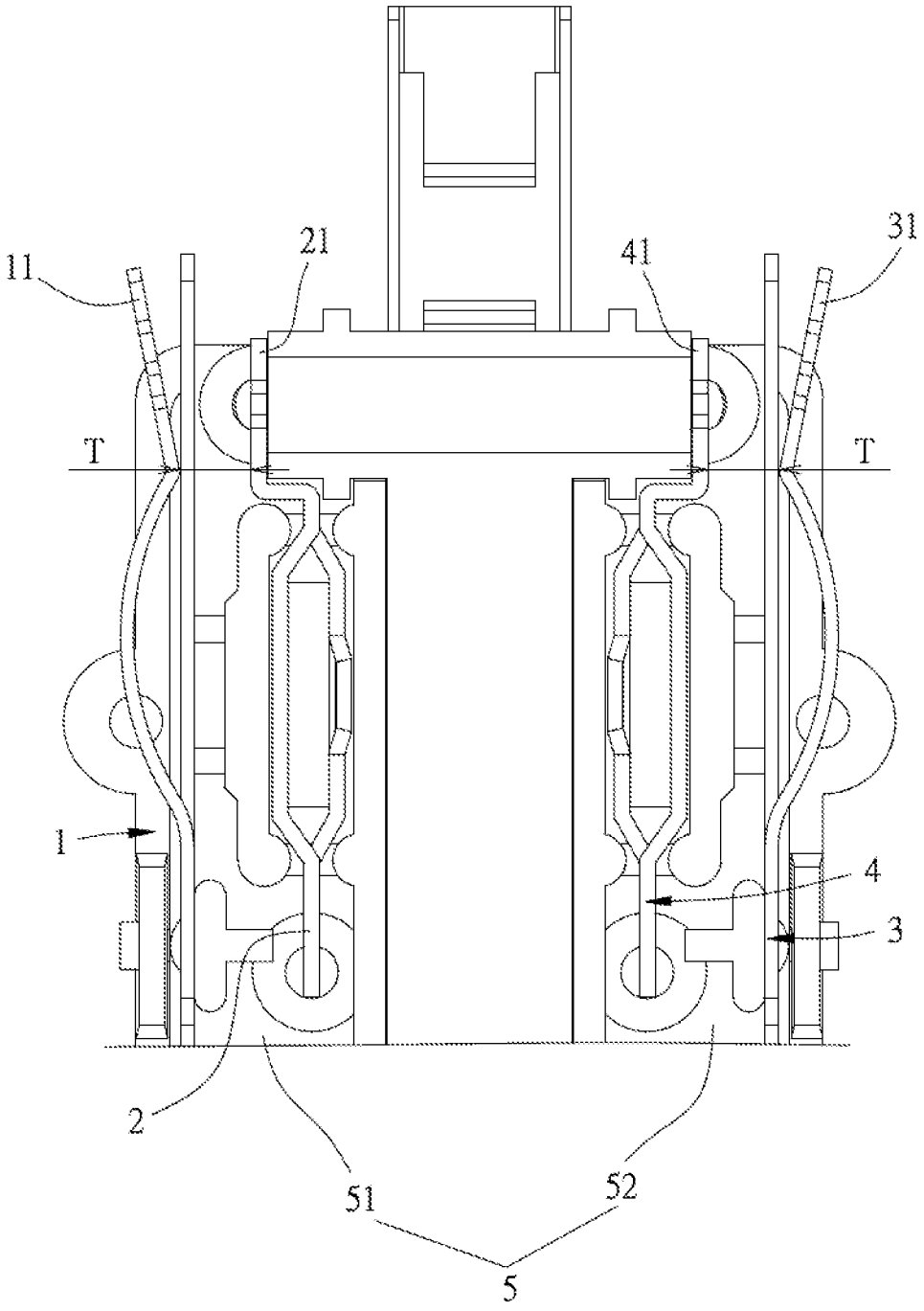
FIG. 3 shows a first planar view of the embodiment of the present invention, illustrating that a predetermined gap is disposed between a live wire spring plate and a live wire contact portion as well as between a neutral wire spring plate and a neural wire contact portion.

Referring to FIG. 3, the seat 5 is provided with a live wire installation portion 51 and a neutral wire installation portion 52. The live wire installation portion 51 is used to install fixedly the live wire conductive plate 1 and the live wire terminals 2 (such as by latching), the neutral wire installation portion 52 is used to install fixedly the neutral wire conductive plate 3 and the neutral wire terminals 4 (such as by latching), and a predetermined gap T is disposed between the live wire spring plate 11 and the live wire contact portion 21 as well as between the neutral wire spring plate 31 and the neutral wire contact portion 41.

Figure 4:
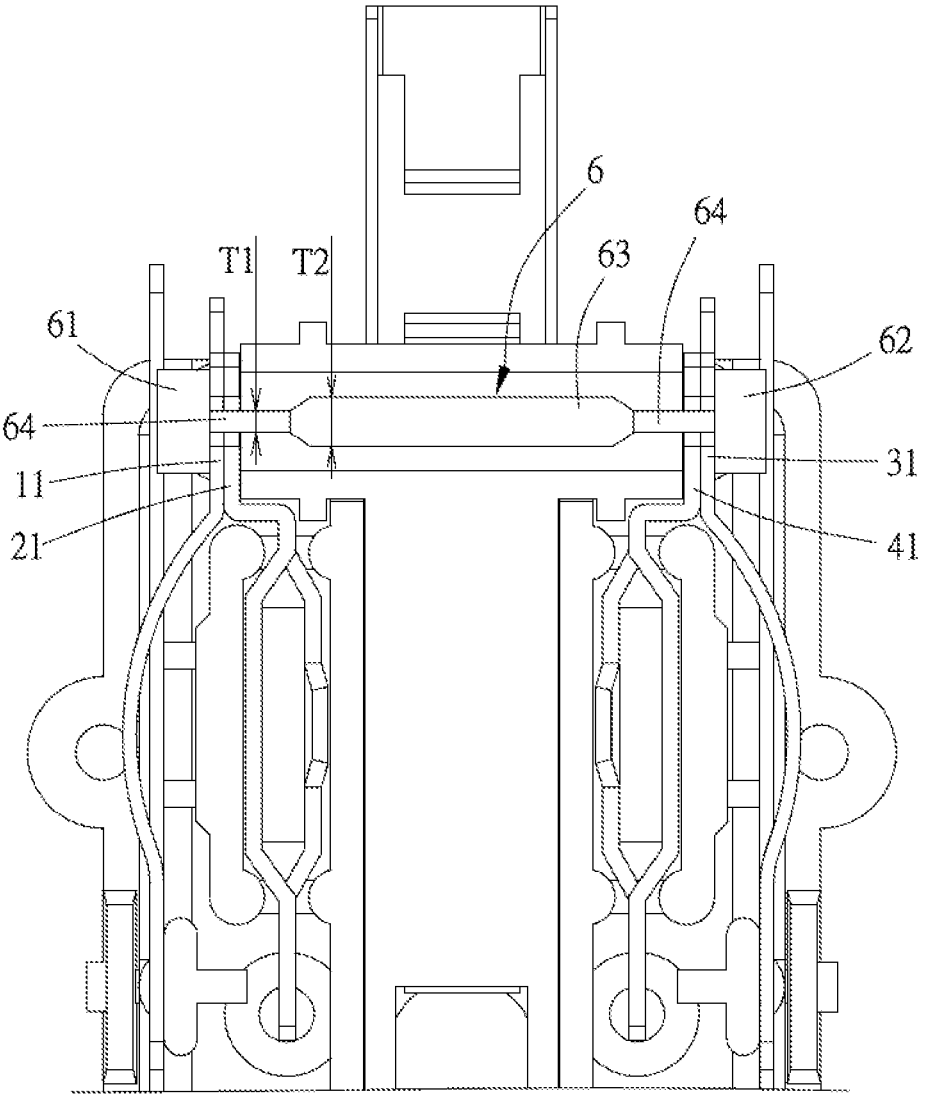
FIG. 4 shows a second planar view of the embodiment of the present invention, illustrating that a protective structure limits the live wire spring plate and the neutral wire spring plate.

Referring to FIG. 4, all the protective structures 6 are provided with a first limiting element 61, a second limiting element 62 and a connecting element 63. The connecting element 63 is connected with the first limiting element 61 and the second limiting element 62, forming an H-shape configuration to each protective structure 6. In the present embodiment, the first limiting element 61, the second limiting element 62 and the connecting element 63 are selectively made of a thermal destructive material, such as plastic. The thermal destructive material is permitted to be damaged at a temperature of 80° C.~299° C., and the first limiting element 61 and the second limiting element 62 are in a plate shape. A destructive portion 64 is disposed between the connecting element 63 and the first limiting element 61 as well as between the connecting element 63 and the second limiting element 62. The thickness T1 of the destructive portion 64 is smaller than the thickness T2 of the connecting element 63. The first limiting element 61 and the second limiting element 62 can be made of, but not limited to, metal as well; whereas the connecting element 63 is made of plastic, so that heat can be transmitted more rapidly and uniformly to assure that the destructive portion 64 can be damaged when the electric circuit is overheated.

Figure 5:
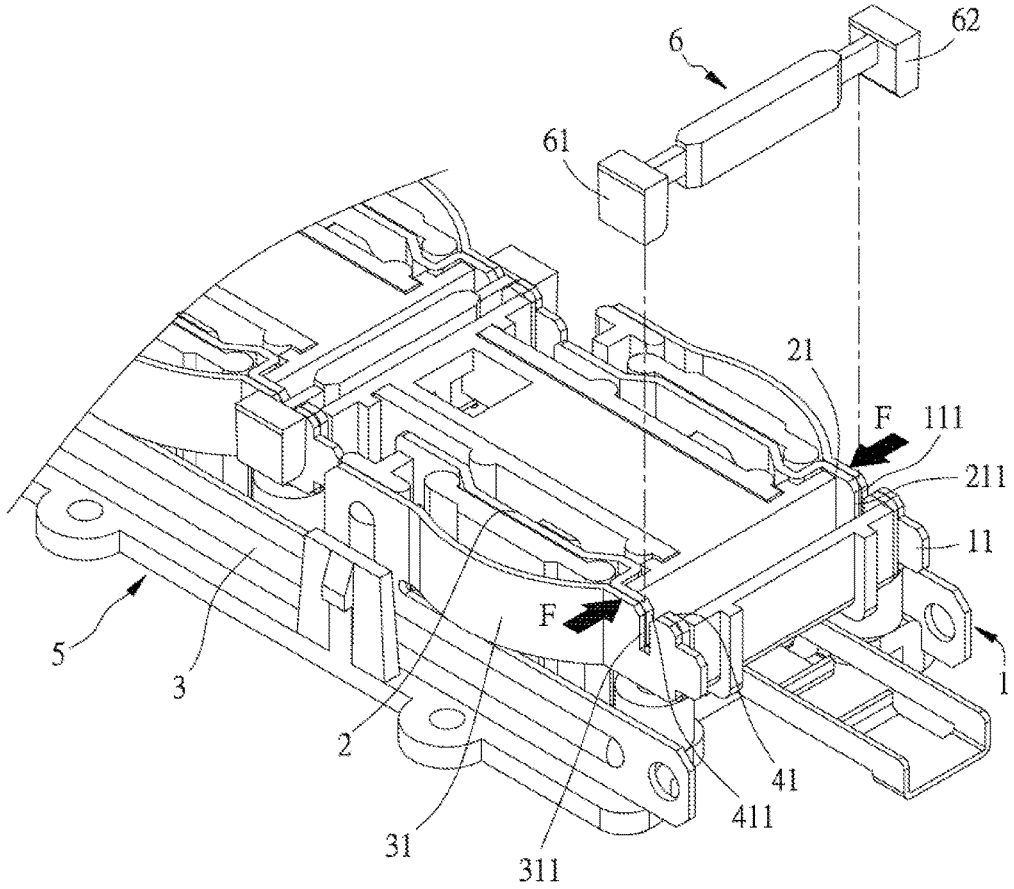
FIG. 5 is a local three-dimensional exploded view of the embodiment of the present invention.

Referring to FIG. 4 and FIG. 5, the first limiting element 61 and the second limiting element 62 are abutted respectively at the live wire spring plate 11 and the neutral wire spring plate 31 to provide a force of constraint, allowing the live wire spring plate 11 and the live wire contact portion 21 to contact with each other as well as the neutral wire spring plate 31 and the neutral wire contact portion 41 to contact with each other. When there is overheating between the live wire spring plate 11 and the live wire contact portion 21 or between the neutral wire spring plate 31 and the neutral wire contact portion 41, the protective structures 6 will be damaged to lose the force of constraint. More specifically, a first notch 111 can be formed on the live wire spring plate 11, a second notch 211 can be formed on the live wire contact portion 21, a third notch 311 can be formed on the neutral wire spring plate 31, and a fourth notch 411 can be formed on the neutral wire contact portion 41. Upon assembling, a force F is applied first, allowing the live wire spring plate 11 to be abutted at the live wire contact portion 21 as well as the neutral wire spring plate 31 to be abutted at the neutral wire contact portion 41. Next, the first limiting element 61 and the second limiting element 62 are made to be abutted respectively at the live wire spring plate 11 and the neutral wire spring plate 31, and by containing the connecting element 63 in the first notch 111, the second notch 211, the third notch 311 and the fourth notch 411, the live wire spring plate 11 and the neutral wire spring plate 31 are limited, such that the live wire spring plate 11 and the live wire contact portion 21 can contact with each other as well as the neutral wire spring plate 31 and the neutral wire contact portion 41 can contact with each other.

Figure 6:
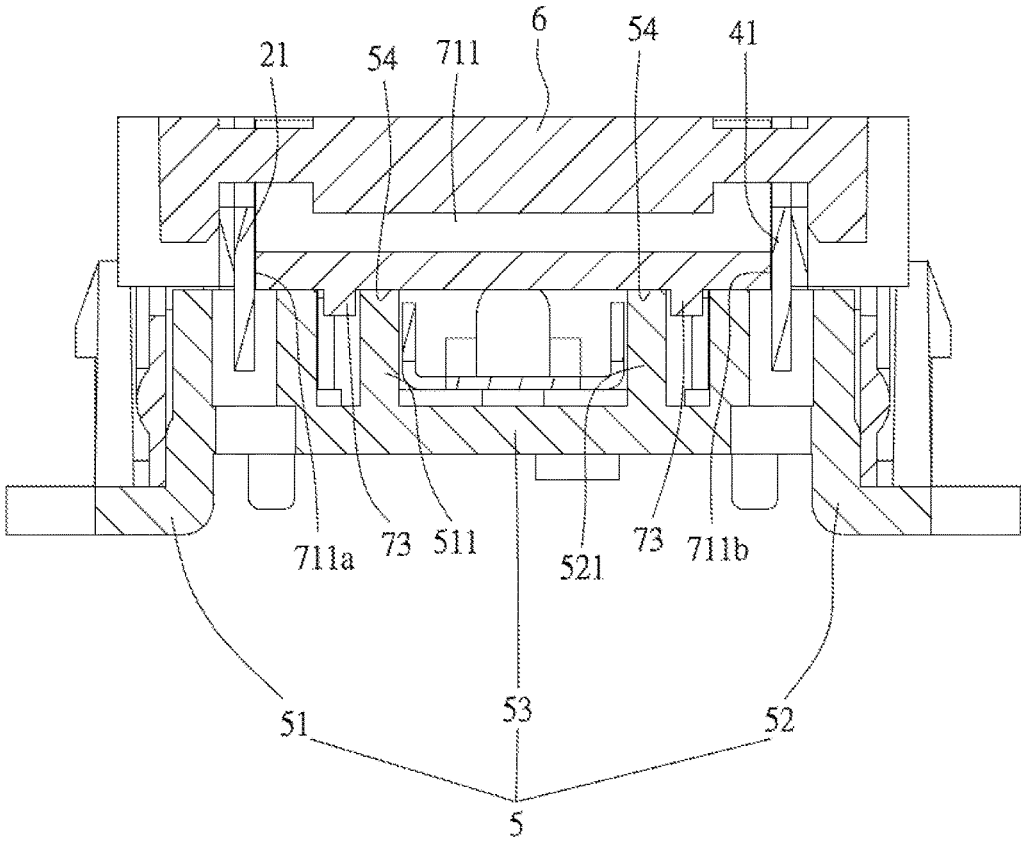
FIG. 6 shows a cutaway view along the line VI-VI in FIG. 1.
Figure 7:
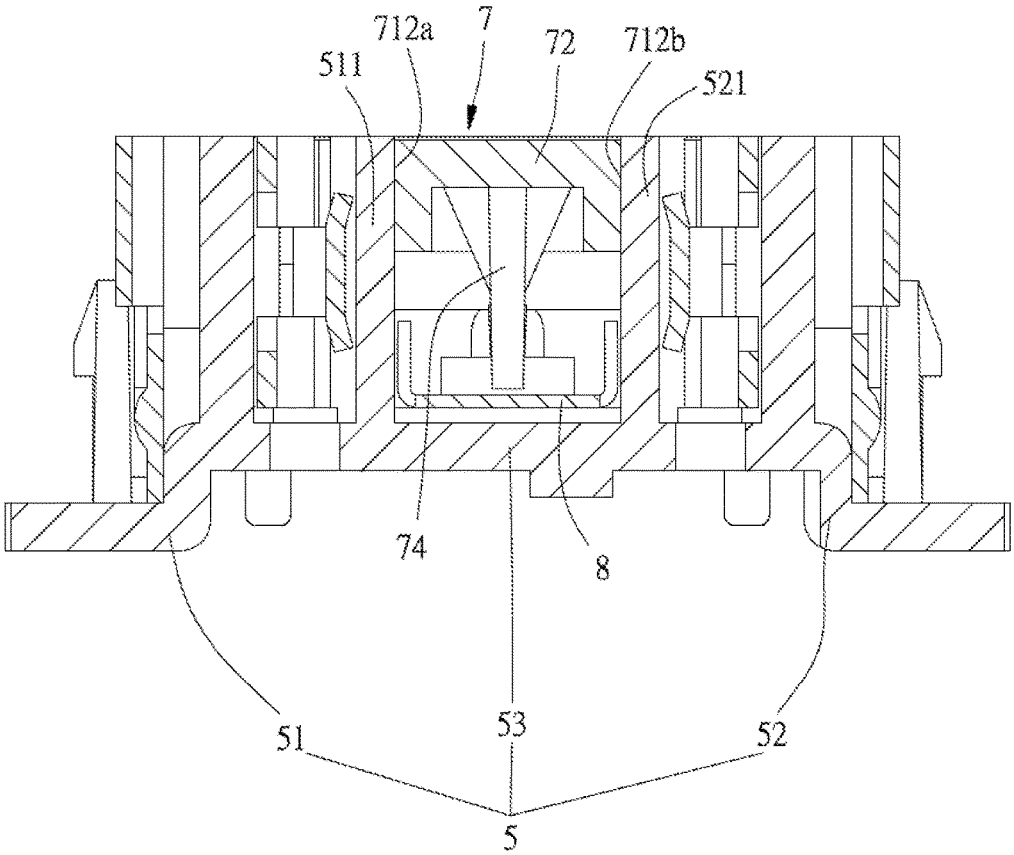
FIG. 7 shows a cutaway view along the line VII-VII in FIG. 1.
Figure 8:
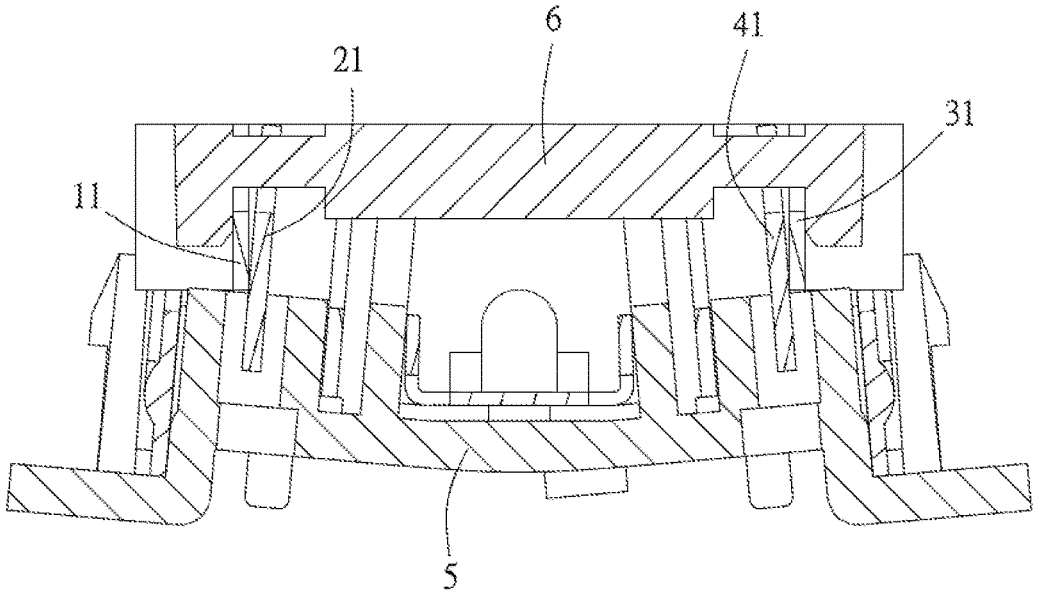
FIG. 8 shows a schematic view of state of the embodiment of the present invention, illustrating that the embodiment is not provided with the support element and is deformed by a force of constraint.

Referring to FIG. 2 again, the support element 7 can be formed integrally with plastic and is provided with plural support units 71. Each support unit 71 includes plural first abutting portions 711*a*, 711*b*, plural second abutting portions 712*a*, 712*b*, and a connecting portion 72. The connecting portion 72 is used to connect with a neighboring support unit 71. As shown in FIG. 6 and FIG. 7, one first abutting portion 711*a* is abutted at the live wire contact portion 21, the other first abutting portion 711*b* is abutted at the neutral wire contact portion 41, one second abutting portion 712*a* is abutted at the live wire installation portion 51, and the other second abutting portion 712*b* is abutted at the neutral wire installation portion 52 to provide a supporting force corresponding to the force of constraint of the protective structure 6. More specifically, the seat 5 further includes a middle portion 53 which is disposed between the live wire installation portion 51 and the neutral wire installation portion 52. A first separation portion 511 is disposed on a side of the live wire installation portion 51 in adjacent to the middle portion 53, and a second separation portion 521 is disposed on a side of the neutral wire installation portion 52 in adjacent to the middle portion 53. The first separation portion 511 and the second separation portion 521 are all provided with a connected installation groove 54, and the support units 71 are disposed in the installation groove 54. The support unit 71 defines a containing groove 711 and two fringes. The containing groove 711 is used to accommodate the protective structure 6, the fringes are disposed at two ends of the containing groove 711 and are abutted directly at the live wire contact portion 21 and the neutral wire contact portion 41 respectively to serve as the first abutting portions 711*a*, 711*b*. Two sides of the connecting portion 72 are abutted respectively at the first separation portion 511 and the second separation portion 521 to serve as the second abutting portions 712*a*, 712*b*. Preferably, the support unit 71 is provided with two fastening portions 73 and a limiting portion 74. The fastening portions 73 are used to correspond with the first separation portion 511 and the second separation portion 521 respectively to limit the support element 7; whereas, the limiting portion 74 is abutted at the ground wire conductive plate 8. Moreover, as the support element 7 provides a supporting force corresponding to the force of constraint of the protective structure 6, the strength of the entire structure is improved and thus the condition shown in FIG. 8 can be avoided. FIG. 8 shows that the seat 5 is deformed by the force of constraint provided by the protective structure 6, and as the live wire spring plates 11, the live wire contact portion 21, the neutral wire spring plates 31, and the neutral wire contact portion 41 are not attached accurately, the contact area will be insufficient to easily result in an issue of overheating.

Figure 9:
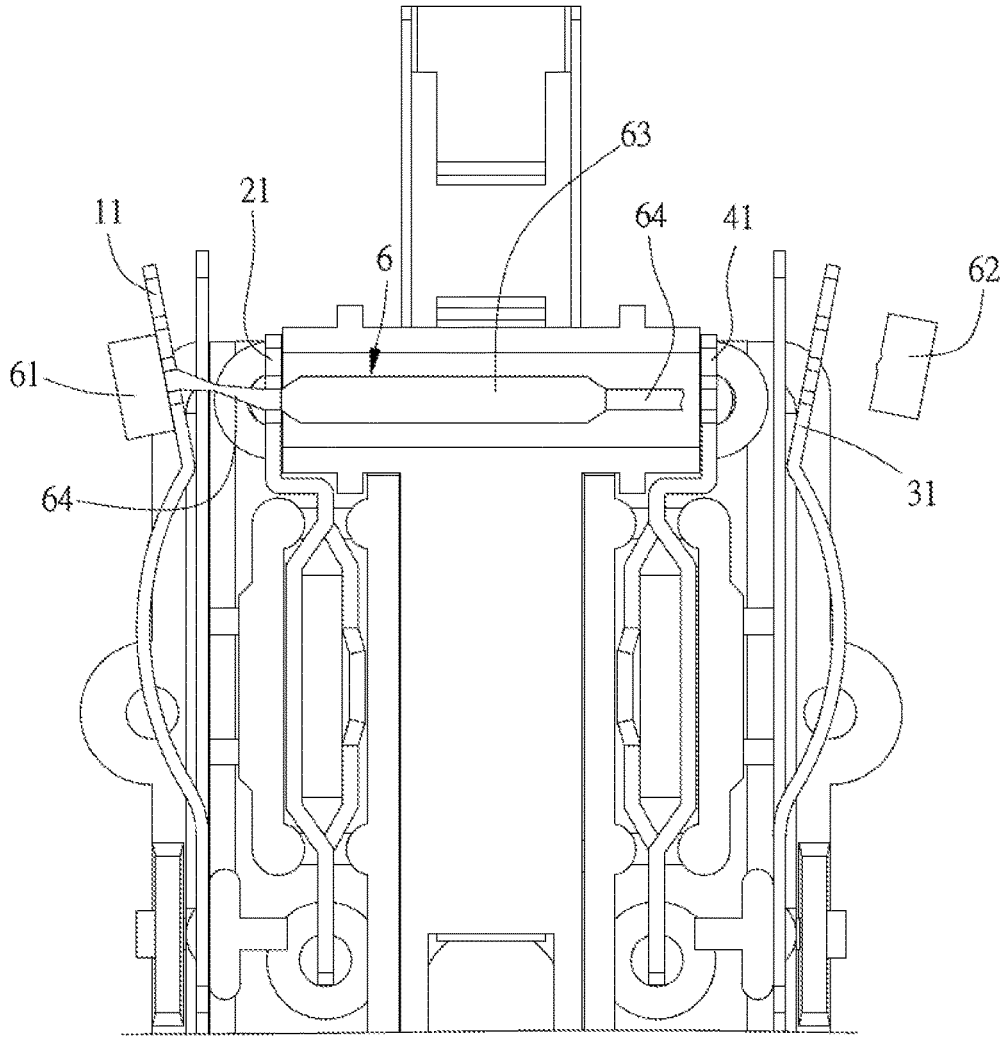
FIG. 9 shows a planar view of the embodiment of the present invention, illustrating that the protective structure is damaged to form open-circuit.

Referring to FIG. 9, upon using the socket, if there is overheating between the live wire spring plate 11 and the live wire contact portion 21 or between the neutral wire spring plate 31 and the neutral wire contact portion 41, any one place in the first limiting element 61, the second limiting element 62 and the connecting element 63 is damaged will enable the first limiting element 61, the second limiting element 62 and the connecting element 63 to lose the original limiting function, allowing the live wire spring plates 11, the live wire contact portion 21, the neutral wire spring plates 31 and the neutral wire contact portion 41 to be separated. For example, in the present embodiment, the destructive portion 64 will usually be damaged when overheating.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A socket which is turned off at a limiting temperature, comprising a live wire conductive plate which is provided with a live wire spring plate;

a live wire terminal which is provided with a live wire contact portion;

a neutral wire conductive plate which is provided with a neutral wire spring plate;

a neutral wire terminal which is provided with a neutral wire contact portion;

a seat which is provided with a live wire installation portion and a neutral wire installation portion, with the live wire installation portion being used to install the live wire conductive plate and the live wire terminal, the neutral wire installation portion being used to install the neutral wire conductive plate and the neutral wire terminal, and a predetermined gap being disposed between the live wire spring plate and the live wire contact portion as well as between the neutral wire spring plate and the neutral wire contact portion;

a protective structure which is provided with a first limiting element, a second limiting element and a connecting element, with the connecting element being connected with the first limiting element and the second limiting element, the first limiting element and the second limiting element being abutted respectively at the live wire spring plate and the neutral wire spring plate to provide a force of constraint so that the live wire spring plate and the live wire contact portion contact with each other as well as the neutral wire spring plate and the neutral wire contact portion contact with each other, and the protective structure being damaged to lose the force of constraint when there is overheating between the live wire spring plate and the live wire contact portion or between the neutral wire spring plate and the neutral wire contact portion; and a support element which is provided with a support unit, with the support unit including a first abutting portion and a second abutting portion, the first abutting portion being abutted at the live wire contact portion and the live wire installation portion, and the second abutting portion being abutted at the neutral wire contact portion and the neutral wire installation portion to provide a supporting force corresponding to the force of constraint.

2. The socket which is turned off at a limiting temperature according to claim 1, wherein the support unit defines a containing groove and two fringes, and the fringes are disposed at two ends of the containing groove and are abutted directly at the live wire contact portion and the neutral wire contact portion respectively to serve as the first abutting portion and the second abutting portion.

3. The socket which is turned off at a limiting temperature according to claim 2, wherein the seat further includes a middle portion, the middle portion is disposed between the live wire installation portion and the neutral wire installation portion, a first separation portion is disposed on a side of the live wire installation portion in adjacent to the middle portion, a second separation portion is disposed on a side of the neutral wire installation portion in adjacent to the middle portion, the first separation portion and the second separation portion are all provided with a connected installation groove, and a part of the support unit is disposed in the installation groove.

4. The socket which is turned off at a limiting temperature according to claim 3, wherein the support unit is provided with two fastening portions which are latched respectively into the first separation portion and the second separation portion.

5. The socket which is turned off at a limiting temperature according to claim 1, wherein the live wire spring plate of the live wire conductive plate, the live wire terminal, the neutral wire terminal and the neutral wire spring plate of the neutral wire conductive plate are all plural and disposed on the seat in pairs.

6. The socket which is turned off at a limiting temperature according to claim 5, wherein the support unit includes a connecting portion to connect with another neighboring support unit.

7. The socket which is turned off at a limiting temperature according to claim 6, wherein the seat further includes a middle portion, a first separation portion and a second separation portion, the middle portion is disposed between the live wire installation portion and the neutral wire installation portion, the first separation portion is disposed on a side of the live wire installation portion in adjacent to the middle portion, the second separation portion is disposed on a side of the neutral wire installation portion in adjacent to the middle portion, and two sides of the connecting portion are abutted respectively at the first separation portion and the second separation portion to serve as the first abutting portion and the second abutting portion.

8. The socket which is turned off at limiting temperature according to claim 7, further comprising a ground wire conductive plate which is disposed on the middle portion, wherein the support unit is provided with a limiting portion which is abutted at the ground wire conductive plate.

9. The socket which is turned off at a limiting temperature according to claim 6, wherein the support element is formed integrally.

* * * * *